US008660461B2

(12) United States Patent
Goda et al.

(10) Patent No.: US 8,660,461 B2
(45) Date of Patent: Feb. 25, 2014

(54) IMAGE FORMING APPARATUS INCLUDING DRUM UNIT ATTACHABLE AND DETACHABLE ALONG DRUM SHAFT

(75) Inventors: Mitsuhiro Goda, Osaka (JP); Susumu Hanano, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 256 days.

(21) Appl. No.: 13/051,120

(22) Filed: Mar. 18, 2011

(65) Prior Publication Data

US 2011/0243604 A1 Oct. 6, 2011

(30) Foreign Application Priority Data

Mar. 30, 2010 (JP) ..... 2010-078193

(51) Int. Cl.
*G03G 15/00* (2006.01)

(52) U.S. Cl.
USPC ..... 399/116

(58) Field of Classification Search
USPC ..... 399/116
See application file for complete search history.

(56) References Cited

U.S. PATENT DOCUMENTS 6,859,635 B2 * 2/2005 Yabuki et al. ..... 399/299
7,400,851 B2 * 7/2008 Kuma et al. ..... 399/299

FOREIGN PATENT DOCUMENTS

JP 07311500 A * 11/1995
JP 8-15938 1/1996
JP 09101638 A * 4/1997
JP 2001-142376 5/2001
JP 2002049290 A * 2/2002

OTHER PUBLICATIONS

Translation of JP09-101638A to Yamamura, Apr. 1997.*

* cited by examiner

*Primary Examiner* — Quana M Grainger
(74) *Attorney, Agent, or Firm* — Dilworth & Barrese, LLP.

(57) ABSTRACT

An image forming apparatus includes a drum unit configured to be attachable to and detachable from the body through inserting the drum shaft into the hollow portion of the photoreceptor drum, a plurality of ribs formed on the drum unit, a guide rail formed in a body, and a plurality of cutouts that is formed in the guide rail is configured to engage with the plurality of ribs when the drum unit is positioned at a regular position. The drum shaft and the guide rail are configured with respect to each other such that a center of the drum shaft is substantially coaxial with a center of the photoreceptor drum when the drum unit slides relative to the body in a state in which the plurality of ribs is placed on the guide rail.

4 Claims, 5 Drawing Sheets

IMAGE FORMING APPARATUS INCLUDING DRUM UNIT ATTACHABLE AND DETACHABLE ALONG DRUM SHAFT

This application is based on and claims the benefit of priority from Japanese Patent Application No. 2010-078193, filed on 30 Mar. 2010, the content of which is incorporated herein by reference.

BACKGROUND OF THE INVENTION

1. Field of the Invention

The present invention relates to an image forming apparatus configured such that a drum unit is attachable to and detachable from a body along a drum shaft.

2. Related Art

In an image forming apparatus such as a copy machine or a printer, an image supporting unit, which has a surface uniformly charged by a charging device, is optically scanned by an optical scanning device, and an electrostatic latent image corresponding to image information is formed on the surface of the image supporting unit such as a photoreceptor drum. Thereafter, the electrostatic latent image is developed by a developing device using toner as a developer, and visualized as a toner image. The toner image is transferred onto a sheet of paper by a transfer device, and then heated, pressurized and fixed onto the sheet of paper by a fixing device. The sheet of paper onto which the toner image is fixed is discharged outside the image forming apparatus, so that a series of image forming steps is terminated.

Incidentally, an image forming apparatus is known in which a photoreceptor drum, a charging device and the like are unitized into a drum unit for easy maintenance and the drum unit is configured to be attachable to and detachable from a body. In such an image forming apparatus employing the features described above, a drum shaft for driving the drum unit is provided in the body such that the drum unit is attached to the body by inserting the drum shaft into an axial center (hollow portion) of the photoreceptor drum and pushing the drum unit along a guide rail and the drum shaft, which are provided in the body. When the attachment of the drum unit is completed, the drum unit is positioned at a regular position by a positioning part provided in the body.

As a setup of positioning an optical deflection unit with respect to a frame of the body, it is known that a V-shaped notch is provided in a bottom surface on an end side of the optical deflection unit and a flange is provided on another end of the optical deflection unit. This setup causes the V-shaped notch formed in the optical deflection unit to engage with a reference shaft of the drum unit, such that the flange of the optical deflection unit is positioned above a height adjustment screw.

Another setup is also known, in which a process cartridge (a drum unit) is inserted into a cartridge slot of the body. In such a setup, a guide portion formed on the process cartridge is inserted along a pair of guide rails. Such a setup includes a technical feature that allows one of the guide rails to be movable in order to implement better handling associated with attachment and detachment of the process cartridge with respect to the body of the image forming apparatus. In the setup described above, the process cartridge is supported by an abutting member of the body when the one of guide rails is lowered through operation of a lever of the body. Accordingly, the positioning part of the process cartridge engages with a groove of the body, so that the process cartridge is positioned with respect to the body.

SUMMARY OF THE INVENTION

Another setup is known in which a drum shaft is inserted into an axial center (hollow portion) of a photoreceptor drum and a drum unit is slidingly attached to and detached from a body along a drum shaft and a guide rail. However, an image forming apparatus employing such a setup has posed a drawback. It may be that since the drum unit places a load on the drum shaft when the drum unit is attached to or detached from the body, the drum shaft deforms, so that rotation of the drum shaft is not smoothly transferred to the photoreceptor drum.

The present invention provides an image forming apparatus that is configured to smoothly attach and detach the drum unit with respect to the body without placing a load on the drum shaft such that the deformation of the drum shaft is prevented.

The present invention relates to an image forming apparatus that includes a body, a drum shaft attached to the body, a plurality of ribs, a guide rail and a plurality of cutouts. The drum unit, which includes a photoreceptor drum with a hollow portion formed in an axial center thereof, is configured to be attachable to and detachable from the body through inserting the drum shaft into the hollow portion of the photoreceptor drum. The plurality of ribs is formed on the drum unit along an attaching and detaching direction of the drum unit with respect to the body. The guide rail, which is formed in the body, is configured to allow the drum unit to slide when the plurality of ribs is placed on the guide rail. The plurality of cutouts that is formed in the guide rail is engaged with the plurality of ribs when the drum unit is positioned at a regular position in the body after completion of attaching the drum unit to the body. The drum shaft and the guide rail are configured with respect to each other such that a center of the drum shaft is substantially coaxial with a center of the photoreceptor drum when the drum unit slides relative to the body in a state in which the plurality of ribs is placed on the guide rail.

According to the present invention, an image forming apparatus is provided that avoids deformation of the drum shaft by smoothly attaching and detaching the drum unit with respect to the body without placing a load on the drum shaft.

DETAILED DESCRIPTION OF THE INVENTION

Embodiments of the present invention will be described hereinafter with reference to the attached drawings.

Figure 1:
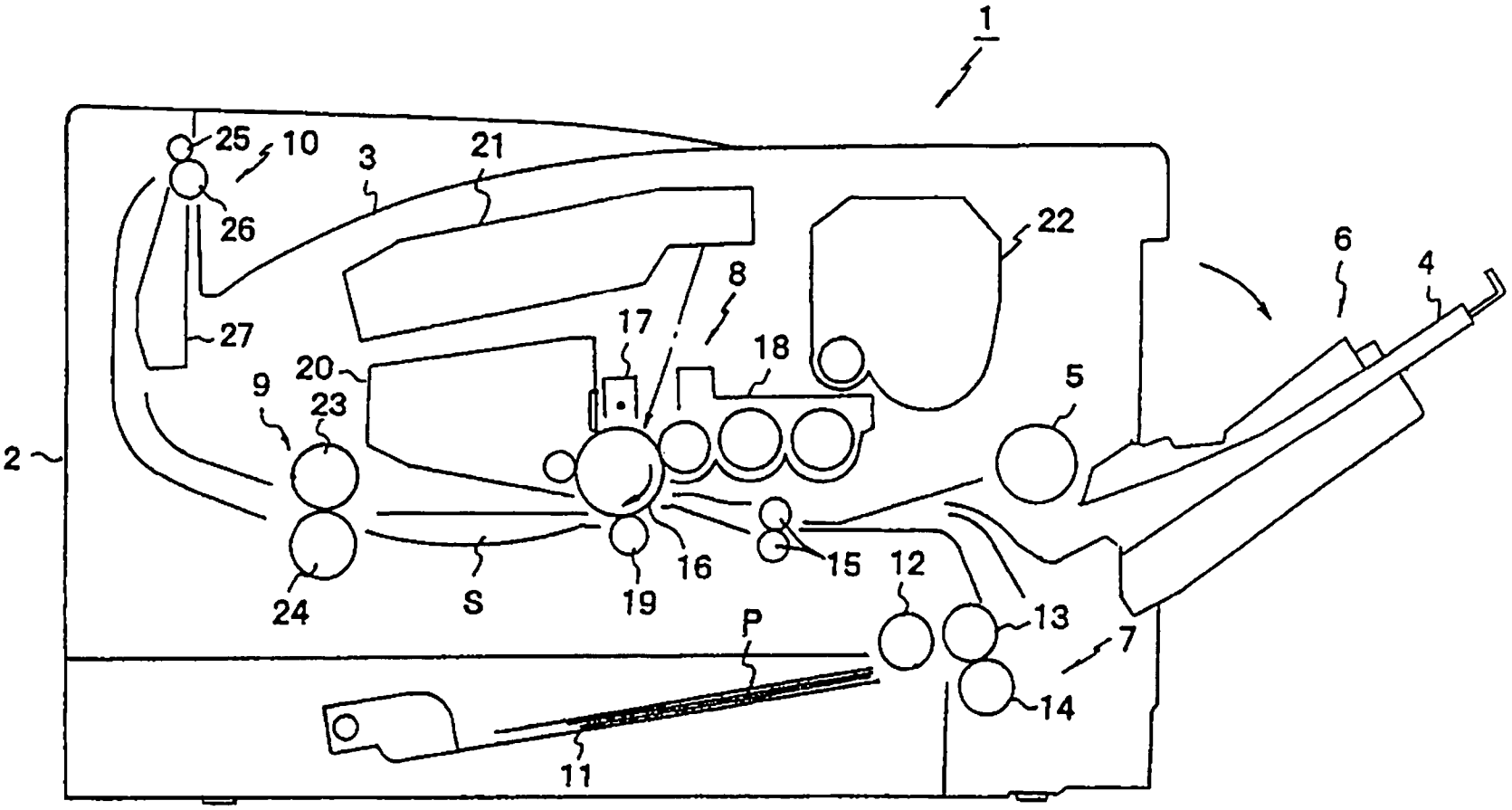
FIG. 1 is a cross-sectional side view of an image forming apparatus (laser printer) according to the present invention.

FIG. 1 is a cross-sectional view of a laser printer 1 as a first embodiment of an image forming apparatus according to the present invention. In the laser printer 1 shown in FIG. 1, a tilted and concave ejected paper tray 3 is provided in a central portion of a top face of a rectangular box-shaped body 2. In addition, a manual feeding tray 4 that is openable and closable is provided in an upper portion of a side of the body 2. The manual feeding tray 4 and a paper feeding roller 5 for manual feeding, which is rotatably provided inside the body 2, compose a manual feeding part 6.

The laser printer 1 forms an image on a sheet of paper P as a recording material based on image data transmitted from a terminal (not illustrated) or the like, while feeding the sheet of paper P along a paper feed path S provided inside the body 2. The paper feed path S is substantially L-shaped in a side view and extends toward the ejected paper tray 3.

The laser printer 1 includes a paper feeding part 7, an image forming part 8, a fixing device 9, and a concave ejection part 10. The paper feeding part 7 is provided in a lower portion of the body 2. The image forming part 8 is provided in a substantially central portion above the paper feeding part 7, inside the body 2. The fixing device 9 is disposed downstream of the image forming part 8. The ejection part 10 is provided above the fixing device 9 on an upper side of the body 2.

The paper feeding part 7 stores a plurality of sheets of paper P stacked inside a paper feeding cassette 11 shaped like an open-top rectangular tray. The paper feeding part 7 is provided with a pick-up roller 12 for picking up a sheet of paper P at a time from the paper feeding cassette 11, and a feeding roller 13 and a retarding roller 14 that separate and feed the sheet of paper P picked up to the paper feed path S, sheet by sheet. The paper feed path S is provided with a pair of resist rollers 15. The pair of resist rollers 15 causes the fed sheet of paper P to temporarily wait and to be fed to the image forming part 8 at predetermined timing.

The image forming part 8 forms an image corresponding to image data on the sheet of paper P that has been fed sheet by sheet from the manual feeding part 6 or the paper feeding part 7. The image forming part 8 includes: a photoreceptor drum 16 as an image supporting unit rotatably disposed in a substantially central portion inside the body 2; a charging device 17 disposed in a periphery of the photoreceptor drum 16; a developing device 18 as developing means; an image transfer roller 19 as image transfer means; a cleaning device 20; an optical scan device (laser scanner unit) 21 disposed above these components; and a toner hopper 22 to contain toner for refilling.

The fixing device 9 is configured to fix a toner image transferred to the sheet of paper P by the image forming part 8. The fixing device 9 is provided with a fixing roller 23 and a pressurizing roller 24 that rotate in pressure contact with each other. The fixing roller 23 is provided with heating means such as a heater. The pressurizing roller 24 is pressurized by biasing means such as a spring with a predetermined pressure against the fixing roller 23, and a fixing nip is formed between the fixing roller 23 and the pressurizing roller 24.

The ejection part 10 is configured to eject the sheet of paper P, onto which the toner image has been fixed by the fixing device 9, to outside the body 2. The ejection part 10 is provided with a pair of paper ejection rollers 25 and 26, disposed one above the other, a plurality of feed guiding ribs 27 shaped like a vertical rib, and the ejected paper tray 3. The pair of paper ejection rollers 25 and 26 is disposed at an end of the paper feed path S. The plurality of feed guiding ribs 27 guides the sheet of paper P being fed from the fixing device 9 along the paper feed path S, to the pair of paper ejection rollers 25 and 26. The ejected paper tray 3 provides a place on which sheets of paper P that have been ejected to outside the body 2 are collected.

Operation to form images performed by the laser printer 1 configured as described above will be hereinafter described.

A terminal such as a personal computer, for example, transmits a print start signal to the laser printer 1. Subsequently, the photoreceptor drum 16 is rotationally driven at a predetermined processing speed in a direction of an arrow shown in FIG. 1 (clockwise direction) by a driving means (not illustrated) in the image forming part 8. A surface of the photoreceptor drum 16 is uniformly charged at a predetermined potential by the charging device 17. Thereafter, the optical scanning device 21 outputs a laser beam based on the image data transmitted from the terminal and casts the laser beam onto the surface of the photoreceptor drum 16. As a result, an electrostatic latent image corresponding to the image data is formed on the surface of the photoreceptor drum 16. The electrostatic latent image formed on the surface of the photoreceptor drum 16 is developed by the developing device 18 using toner as a developer, and visualized as a toner image.

In a case of cassette feeding, a topmost sheet of paper P is first picked up by the pick-up roller 12, followed by another sheet of paper T at a time from the sheets of paper P housed inside the paper feeding cassette 11 of the paper feeding part 7. Then, the sheets of paper P are separated by the feeding roller 13 and the retarding roller 14 sheet by sheet and fed to the pair of resist rollers 15. At the pair of resist rollers 15, a sheet of paper P is temporarily maintained to stand by and is fed to the image forming part 8 at predetermined timing synchronized with the toner image on the surface of the photoreceptor drum 16.

In the image forming part 8, the sheet of paper P fed to a transfer nip between the photoreceptor drum 16 and the image transfer roller 19 is fed while being pressed against the photoreceptor drum 16 by the transfer roller 19. Accordingly, the toner image on the surface of the photoreceptor drum 16 is drawn to the transfer roller 19, and transferred to the sheet of paper P that has been fed to the transfer nip. The sheet of paper P onto which the toner image has been transferred is fed to the fixing device 9. In the fixing device 9, the sheet of paper P, onto which the toner image has been transferred, is fed, heated and pressurized while being sandwiched by a fixing nip formed between the fixing roller 23 and the pressurizing roller 24. In this manner, the toner image transferred to the sheet of paper P is fixed. Residual toner, which remains on the surface of the photoreceptor drum 16 after the transfer of the toner image to the sheet of paper P, is removed by the cleaning device 20. The photoreceptor drum 16 whose surface has been cleaned is ready for a next image forming operation.

The sheet of paper P onto which the toner image has been fixed by the fixing device 9 is fed to an upper side of the paper feed path S toward the ejection part 10. The sheet of paper P is guided to the pair of paper ejection rollers 25, 26 along the feed guiding ribs 27. Thereafter, the sheet of paper P is ejected to outside the body 2 while being sandwiched between the pair of paper ejection rollers 25, 26. The sheet of paper P is placed on the ejected paper tray 3 provided in the upper portion of the body 2. As a result, a series of image forming operations is completed.

When a user manually feeds a sheet of paper P, the sheet of paper P placed on the manual feeding tray 4 of the manual feeding part 6 is fed to the pair of resist rollers 15 by the paper feeding roller S for manual feeding. Thereafter, an image is formed on the sheet of paper P in a similar process to the above described. The sheet of paper P on which the image has been formed is placed on the ejected paper tray 3 outside the body 2.

In the laser printer 1 according to the present embodiment, the photoreceptor drum 16 and the charging device 17 are unitized into a drum unit 30 (described later, refer to FIGS. 2 and 3) for the sake of easy maintenance and the like. The drum unit 30 is configured to be attachable to and detachable from the body 2.

An attachment/detachment structure of the drum unit 30 and steps of attaching it to the body 2 will be described hereinafter with reference to FIGS. 2 to 5.

Figure 2:
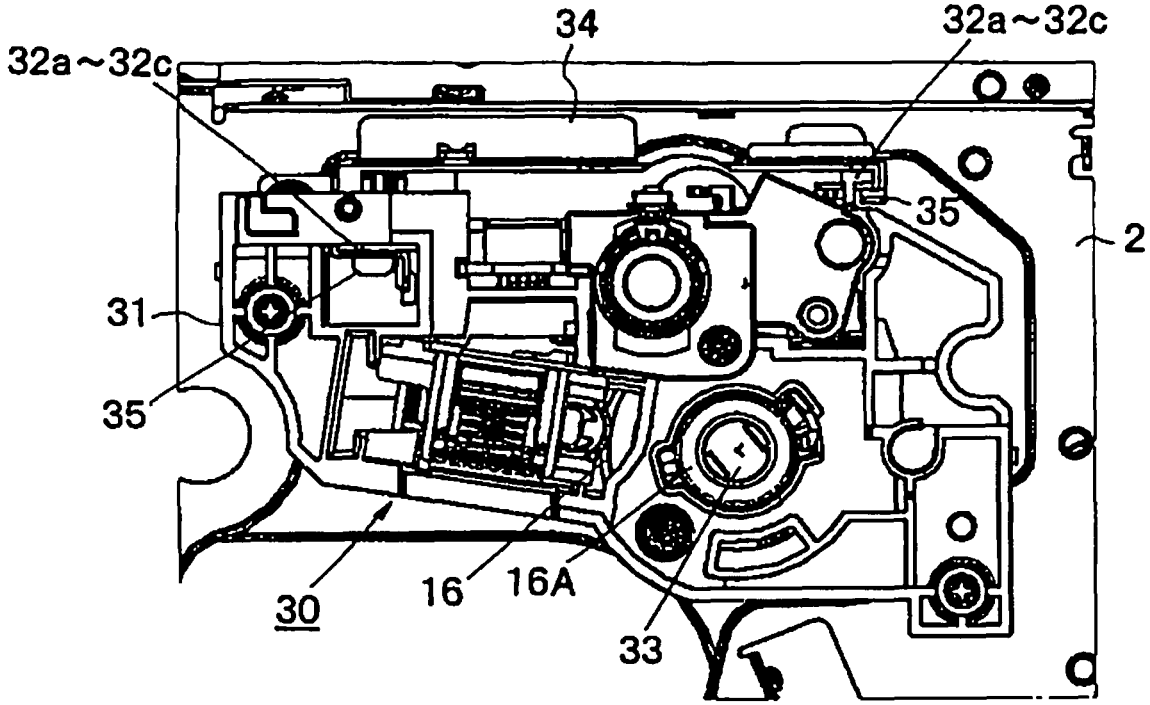
FIG. 2 is a front view showing an attachment/detachment setup of a drum unit of the image forming apparatus according to the present invention.
Figure 3:
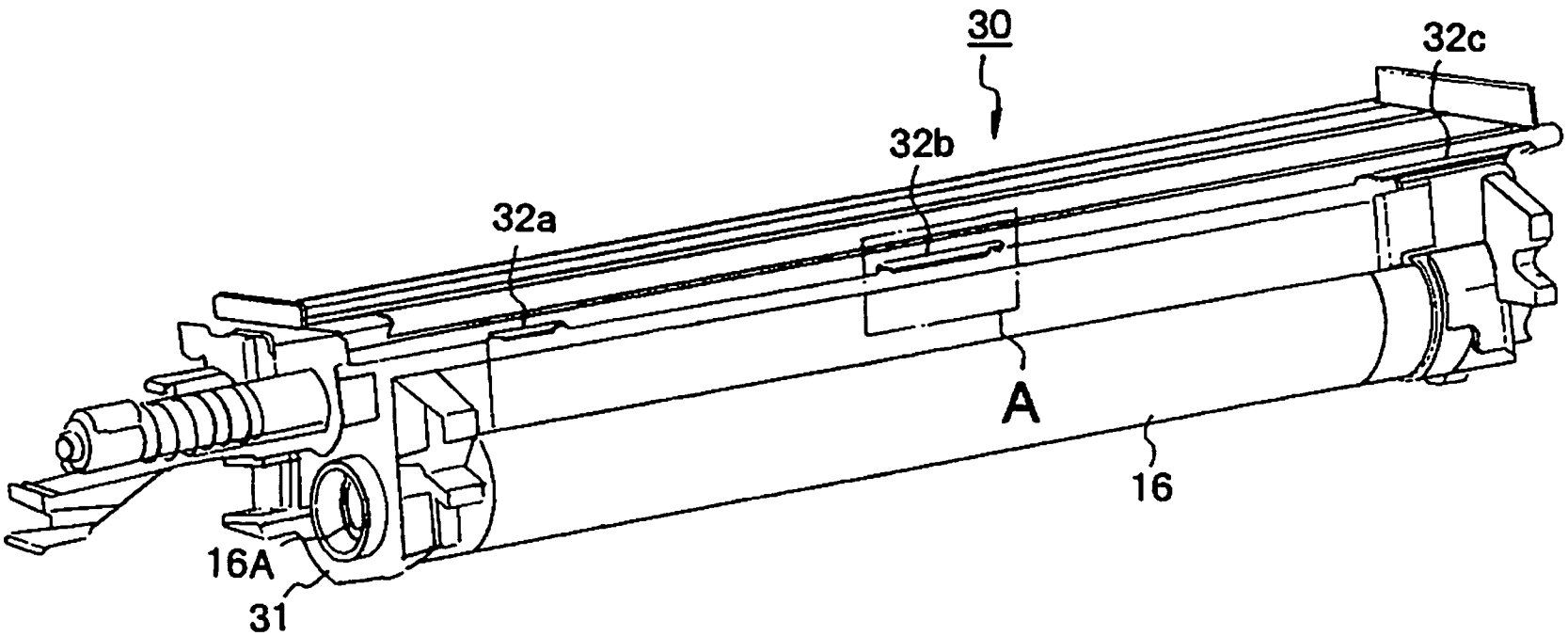
FIG. 3 is a perspective view of the drum unit of the image forming apparatus according to the present invention.
Figure 4:
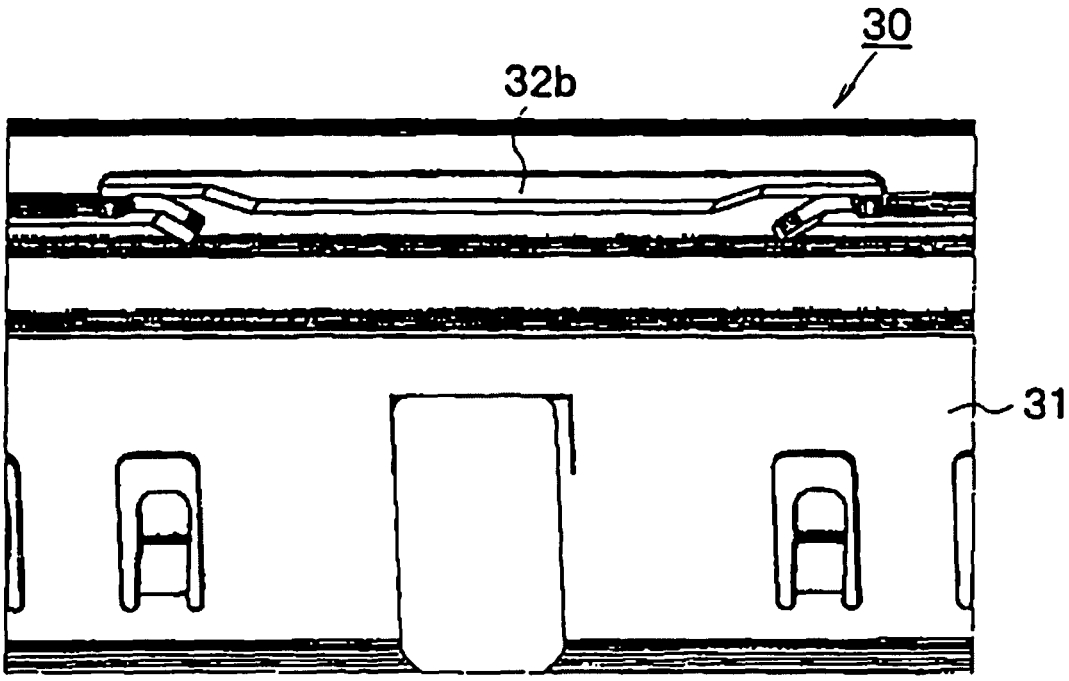
FIG. 4 is an enlarged detailed view of a portion A of FIG. 3.

FIG. 2 is a front view showing the attachment/detachment structure of the drum unit;

FIG. 3 is a perspective view of the drum unit;

FIG. 4 is an enlarged detailed view of a portion A of FIG. 3; and

Figure 5A:
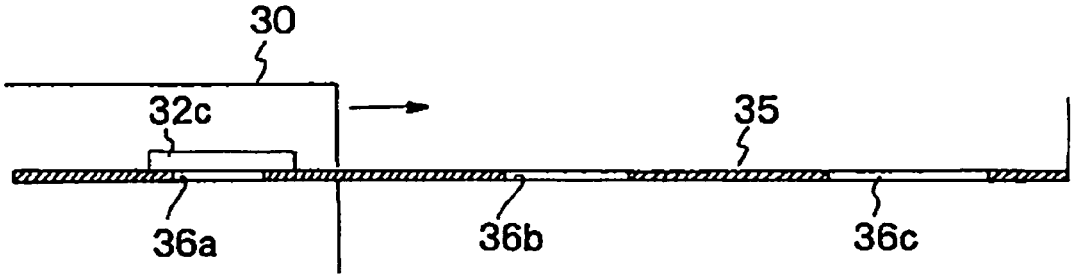
FIGS. 5A to 5C are diagrams schematically showing a positional relationship between ribs on the drum unit and cutouts in a guide rail when the drum unit is attached, in the image forming apparatus according to the present invention.
Figure 5B:
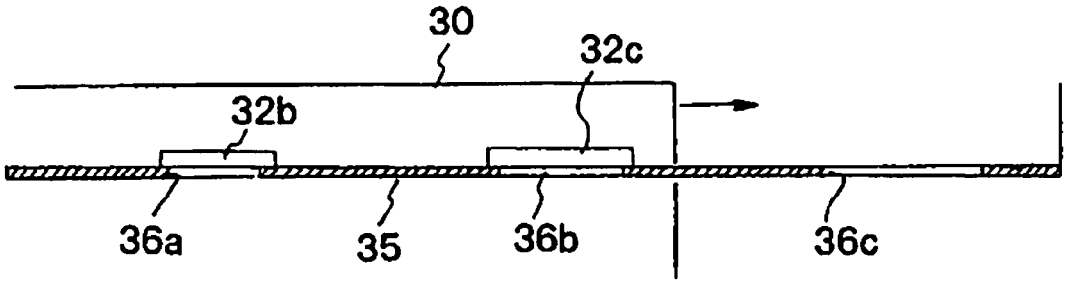
Figure 5C:
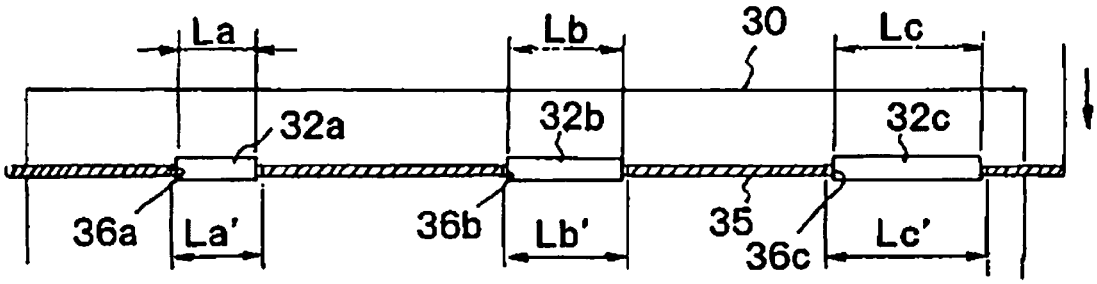

FIGS. 5A to 5C are diagrams schematically showing a positional relationship between ribs on the drum unit and cutouts in a guide rail when the drum unit is installed.

As shown in FIGS. 2 and 3, a housing 31 of the drum unit 30 rotatably supports the photoreceptor drum 16. In an axial center of the photoreceptor drum 16, a hollow portion 16A is formed to penetrate in a longitudinal direction (a direction vertical to a paper surface of FIG. 2). In addition, on both sides of an upper portion of the housing 31, as shown in FIGS. 3 and 4, three ribs 32*a*, 32*b* and 32*c* (FIGS. 3 and 4 show only ribs on one side) are formed at appropriate intervals along the longitudinal direction.

As shown in FIG. 2, on a rear side of the apparatus main body 2 (a rear side of a paper surface of FIG. 2), a drum shaft 33 is horizontally supported toward a front side. In addition, on right and left sides of a main frame 34, two L-shaped guide rails 35 are horizontally formed in face-to-face relation along a longitudinal direction (a direction vertical to a paper surface of FIG. 2). As shown in FIGS. 5A to 5C, each of the guide rails 35 is provided with three cutouts 36*a*, 36*b* and 36*c* formed at appropriate intervals (the same intervals as the ribs 32*a*, 32*b* and 32*c*). The three cutouts 36*a*, 36*b* and 36*c* correspond to the three ribs 32*a*, 32*b* and 32*c* formed on the drum unit 30. Here, lengths (lengths in the longitudinal direction) La, Lb and Lc of the ribs 32*a*, 32*b* and 32*c* and lengths (lengths in the longitudinal direction) La', Lb' and Lc' of the cutouts 36*a*, 36*b* and 36*c* are configured to be greater in increasing order from upstream (a front side, a left side of FIG. 5C) to downstream of an insertion direction of the drum unit 30 (La<Lb<Lc, La'<Lb'<Lc'). In addition, the plurality of ribs 32*a*, 32*b* and 32*c* are configured to be engageable with the corresponding cutouts 36*a*, 36*b* and 36*c* (La<La', Lb<Lb', Lc<Lc').

When the drum unit 30 is attached to the body 2, the horizontal drum shaft 33 provided in the body 2 is inserted into the hollow portion 16A of the photoreceptor drum 16, as shown in FIG. 2. The drum unit 30 is slidingly inserted deeper into the body 2 along the drum shaft 33 and the guide rails 35, while the ribs 32*a*, 32*b* and 32*c*, which are formed on the right and left side of the upper portion of the housing 31 of the drum unit 30, are placed on the guide rails 35 of the main frame 34.

Here, in the present embodiment, the drum shaft 33 and the guide rails 35 provided in the body 2 are configured to be positioned such that a center of the drum shaft 33 is coaxial with a center of the photoreceptor drum 16 when the drum unit 30 is caused to slide toward the body 2 with the ribs 32*a*, 32*b* and 32*c* formed on the drum unit 30 being placed on the guide rails 35. Accordingly, the drum unit 30 slides smoothly without placing a load on the drum shaft 33 when the drum unit 30 is attached to the body 2. In this manner, it is possible to avoid deformation of the drum shaft 33 and allow smooth rotation of the photoreceptor drum 16.

As described above, the lengths La, Lb and Lc of the ribs 32*a*, 32*b* and 32*c*, and the lengths La', Lb' and Lc' of the cutouts 36*a*, 36*b* and 36*c*, are configured to be greater in increasing order from upstream (front side) (left side of FIG. 5C) to downstream of an insertion direction of the drum unit 30 (La<Lb<Lc, La'<Lb'<Lc'). As shown in FIG. 5A, for example, the longest rib 32*c* on a deeper side (downstream of the insertion direction) travels beyond the shortest cutout 36*a* without falling thereinto (without engaging therewith (La'<Lc). In addition, as shown in FIG. 5B, the longest rib 32*c* on the deeper side (downstream of the insertion direction) travels beyond the second longest cutout 36*b* in the center location without falling thereinto (Lb'<Lc). Similarly, the second longest rib 32*b* in the center location travels beyond the shortest cutout 36*a* without falling thereinto (without engaging therewith) (La'<Lb). Accordingly, it is possible to cause the drum unit 30 to smoothly slide along the guide rails 35, and to be attached to and detached from the body 2 (La'<Lb'<Lc, La'<Lb).

In this manner, attaching the drum unit 30 to the body 2 is completed. When the drum unit 30 is positioned and maintained at a regular position in the body 2, as shown in FIG. 5C, the three ribs 32*a*, 32*b* and 32*c* formed on the drum unit 30 engage with the corresponding three cutouts 36*a*, 36*b* and 36*c* formed in the guide rails 35. Accordingly, the drum unit 30 is caused to slide up to the regular position in an unrestricted state with respect to the guide rails 35. As a result, the drum unit 30 is accurately positioned and maintained at the regular position in the body 2, without being restricted by the guide rails 35. The photoreceptor drum 16 is rotationally driven at a predetermined speed by a driving force exerted by a motor (not illustrated), which is an actuator provided in the body 2.

The steps of attaching the drum unit 30 to the body 2 have been described. Similarly, it is possible to detach the drum unit 30 from the body 2 smoothly without placing a load on the drum shaft 33 by performing the steps in a reversed order.

As described above, according to the present invention, it is possible to cause the drum unit 30 to be smoothly attached to and detached from the body 2 without placing a load on the drum shaft 33. Accordingly, it is possible to avoid deformation of the drum shaft 33. In addition, it is possible to install the drum unit 30 at the regular position accurately positioned in the apparatus main body 2.

It should be noted that, although the above description has been provided for the embodiment of the present invention applied to a laser printer, the present invention can be equally applied to other image forming apparatuses such as a copy machine, a facsimile machine and the like provided with a drum unit.

What is claimed is:

1. An image forming apparatus comprising:

a body;

a drum shaft attached to the body;

a drum unit, which includes a photoreceptor drum with a hollow portion formed in an axial center thereof, configured to be attachable to and detachable from the body through inserting the drum shaft into the hollow portion of the photoreceptor drum;

a plurality of ribs that is formed on the drum unit along an attaching and detaching direction of the drum unit with respect to the body;

a guide rail, which is formed in the body, configured to allow the drum unit to slide when the plurality of ribs is placed on the guide rail; and a plurality of cutouts formed in the guide rail, the plurality of cutouts being engaged with the plurality of ribs when the drum unit is positioned at a regular position in the body after completion of attaching the drum unit to the body, and lengths of the plurality of cutouts being configured to be greater in increasing order from upstream to downstream of a direction in which the drum unit is inserted into the body;

wherein the drum shaft and the guide rail are configured with respect to each other such that a center of the drum shaft is substantially coaxial with a center of the photoreceptor drum when the drum unit slides relative to the body in a state in which the plurality of ribs is placed on the guide rail.

2. The image forming apparatus according to claim 1, wherein lengths of the plurality of ribs are configured to be greater in increasing order from the upstream to the downstream of the direction in which the drum unit is inserted into the body.

3. The image forming apparatus according to claim 1, wherein the plurality of ribs is configured to engage with the corresponding plurality of cutouts respectively, and wherein the plurality of ribs slides on the guide rail such that a longer rib travels beyond a shorter cutout when the drum unit is attached to the body, and each of the plurality of ribs is configured to engage with corresponding one of the plurality of cutouts when attachment of the drum unit to the body is completed.

4. The drum unit used for the image forming apparatus according to claim 1, wherein the plurality of ribs is configured to be greater in increasing order along an inserting direction of the drum unit with respect to the image forming apparatus.

* * * * *